US009978388B2

(12) United States Patent
Avendano et al.

(10) Patent No.: US 9,978,388 B2
(45) Date of Patent: May 22, 2018

(54) SYSTEMS AND METHODS FOR RESTORATION OF SPEECH COMPONENTS

(71) Applicant: Knowles Electronics, LLC, Itasca, IL (US)

(72) Inventors: Carlos Avendano, Campbell, CA (US); John Woodruff, Palo Alto, CA (US)

(73) Assignee: Knowles Electronics, LLC, Itasca, IL (US)

( * ) Notice: Subject to any disclaimer, the term of this patent is extended or adjusted under 35 U.S.C. 154(b) by 0 days. days.

(21) Appl. No.: 14/852,446

(22) Filed: Sep. 11, 2015

(65) Prior Publication Data

US 2016/0078880 A1 Mar. 17, 2016

Related U.S. Application Data

(60) Provisional application No. 62/049,988, filed on Sep. 12, 2014.

(51) Int. Cl.
*G10L 21/00* (2013.01)
*G10L 21/02* (2013.01)
(Continued)

(52) U.S. Cl.
CPC ..... *G10L 21/02* (2013.01); *G10L 21/0208* (2013.01); *G10L 21/038* (2013.01); *G10L 25/30* (2013.01)

(58) Field of Classification Search
None
See application file for complete search history.

(56) References Cited

U.S. PATENT DOCUMENTS 4,025,724 A 5/1977 Davidson, Jr. et al.
4,137,510 A 1/1979 Iwahara
(Continued)

FOREIGN PATENT DOCUMENTS

CN 105474311 A 4/2016
DE 112014003337 T5 3/2016
(Continued)

OTHER PUBLICATIONS

Non-Final Office Action, dated Aug. 5, 2008, U.S. Appl. No. 11/441,675, filed May 25, 2006.
(Continued)

*Primary Examiner* — Marcus T Riley
(74) *Attorney, Agent, or Firm* — Foley & Lardner LLP

(57) ABSTRACT

A method for restoring distorted speech components of an audio signal distorted by a noise reduction or a noise cancellation includes determining distorted frequency regions and undistorted frequency regions in the audio signal. The distorted frequency regions include regions of the audio signal in which a speech distortion is present. Iterations are performed using a model to refine predictions of the audio signal at distorted frequency regions. The model is configured to modify the audio signal and may include deep neural network trained using spectral envelopes of clean or undamaged audio signals. Before each iteration, the audio signal at the undistorted frequency regions is restored to values of the audio signal prior to the first iteration; while the audio signal at distorted frequency regions is refined starting from zero at the first iteration. Iterations are ended when discrepancies of audio signal at undistorted frequency regions meet pre-defined criteria.

20 Claims, 5 Drawing Sheets

(51) Int. Cl.

| | |
|---|---|
| *G10L 25/30* | (2013.01) |
| *G10L 21/0208* | (2013.01) |
| *G10L 21/038* | (2013.01) |

(56) References Cited

U.S. PATENT DOCUMENTS 4,802,227 A 1/1989 Elko et al.
4,969,203 A 11/1990 Herman
5,115,404 A 5/1992 Lo et al.
5,204,906 A 4/1993 Nohara et al.
5,224,170 A 6/1993 Waite, Jr.
5,230,022 A 7/1993 Sakata
5,289,273 A 2/1994 Lang
5,400,409 A 3/1995 Linhard
5,440,751 A 8/1995 Santeler et al.
5,544,346 A 8/1996 Mini et al.
5,555,306 A 9/1996 Gerzon
5,583,784 A 12/1996 Kapust et al.
5,598,505 A 1/1997 Austin et al.
5,625,697 A 4/1997 Bowen et al.
5,682,463 A 10/1997 Allen et al.
5,715,319 A 2/1998 Chu
5,734,713 A 3/1998 Mauney et al.
5,774,837 A 6/1998 Yeldener et al.
5,796,850 A 8/1998 Shiono et al.
5,806,025 A 9/1998 Vis et al.
5,819,215 A 10/1998 Dobson et al.
5,937,070 A 8/1999 Todter et al.
5,956,674 A 9/1999 Smyth et al.
5,974,379 A 10/1999 Hatanaka et al.
5,974,380 A 10/1999 Smyth et al.
5,978,567 A 11/1999 Rebane et al.
5,978,759 A * 11/1999 Tsushima ..... G10L 21/038 704/219
5,978,824 A 11/1999 Ikeda
5,991,385 A 11/1999 Dunn et al.
6,011,853 A 1/2000 Koski et al.
6,035,177 A 3/2000 Moses et al.
6,065,883 A 5/2000 Herring et al.
6,084,916 A 7/2000 Ott
6,104,993 A 8/2000 Ashley
6,144,937 A 11/2000 Ali
6,188,769 B1 2/2001 Jot et al.
6,202,047 B1 3/2001 Ephraim et al.
6,219,408 B1 4/2001 Kurth
6,226,616 B1 5/2001 You et al.
6,240,386 B1 5/2001 Thyssen et al.
6,263,307 B1 7/2001 Arslan et al.
6,281,749 B1 8/2001 Klayman et al.
6,327,370 B1 12/2001 Killion et al.
6,377,637 B1 4/2002 Berdugo
6,381,284 B1 4/2002 Strizhevskiy
6,381,469 B1 4/2002 Wojick
6,389,142 B1 5/2002 Hagen
6,421,388 B1 7/2002 Parizhsky et al.
6,477,489 B1 11/2002 Lockwood et al.
6,480,610 B1 11/2002 Fang
6,490,556 B1 12/2002 Graumann et al.
6,496,795 B1 12/2002 Malvar
6,504,926 B1 1/2003 Edelson et al.
6,584,438 B1 6/2003 Manjunath et al.
6,717,991 B1 4/2004 Gustafsson et al.
6,748,095 B1 6/2004 Goss
6,768,979 B1 7/2004 Menendez-Pidal et al.
6,772,117 B1 8/2004 Laurila et al.
6,810,273 B1 10/2004 Mattila et al.
6,862,567 B1 3/2005 Gao
6,873,837 B1 3/2005 Yoshioka et al.
6,882,736 B2 4/2005 Dickel et al.
6,907,045 B1 6/2005 Robinson et al.
6,931,123 B1 8/2005 Hughes
6,980,528 B1 12/2005 LeBlanc et al.
7,010,134 B2 3/2006 Jensen
RE39,080 E 4/2006 Johnston
7,035,666 B2 4/2006 Silberfenig et al.
7,054,809 B1 5/2006 Gao
7,058,572 B1 6/2006 Nemer
7,058,574 B2 6/2006 Taniguchi et al.
7,103,176 B2 9/2006 Rodriguez et al.
7,145,710 B2 12/2006 Holmes
7,190,775 B2 3/2007 Rambo
7,221,622 B2 5/2007 Matsuo et al.
7,245,710 B1 7/2007 Hughes
7,254,242 B2 8/2007 Ise et al.
7,283,956 B2 10/2007 Ashley et al.
7,366,658 B2 4/2008 Moogi et al.
7,383,179 B2 6/2008 Alves et al.
7,433,907 B2 10/2008 Nagai et al.
7,447,631 B2 11/2008 Truman et al.
7,472,059 B2 12/2008 Huang
7,548,791 B1 6/2009 Johnston
7,555,434 B2 6/2009 Nomura et al.
7,562,140 B2 7/2009 Clemm et al.
7,590,250 B2 9/2009 Ellis et al.
7,617,099 B2 11/2009 Yang et al.
7,617,282 B2 11/2009 Han
7,657,427 B2 2/2010 Jelinek
7,664,495 B1 2/2010 Bonner et al.
7,685,132 B2 3/2010 Hyman
7,773,741 B1 8/2010 LeBlanc et al.
7,791,508 B2 9/2010 Wegener
7,796,978 B2 9/2010 Jones et al.
7,899,565 B1 3/2011 Johnston
7,970,123 B2 6/2011 Beaucoup
8,032,369 B2 10/2011 Manjunath et al.
8,036,767 B2 10/2011 Soulodre
8,046,219 B2 10/2011 Zurek et al.
8,060,363 B2 11/2011 Ramo et al.
8,098,844 B2 1/2012 Elko
8,150,065 B2 4/2012 Solbach et al.
8,175,291 B2 5/2012 Chan et al.
8,189,429 B2 5/2012 Chen et al.
8,194,880 B2 6/2012 Avendano
8,194,882 B2 6/2012 Every et al.
8,195,454 B2 6/2012 Muesch
8,204,253 B1 6/2012 Solbach
8,229,137 B2 7/2012 Romesburg
8,233,352 B2 7/2012 Beaucoup
8,311,817 B2 11/2012 Murgia et al.
8,311,840 B2 * 11/2012 Giesbrecht ..... G10L 21/038 704/200.1
8,345,890 B2 1/2013 Avendano et al.
8,363,823 B1 1/2013 Santos
8,369,973 B2 2/2013 Risbo
8,467,891 B2 6/2013 Huang et al.
8,473,287 B2 6/2013 Every et al.
8,531,286 B2 9/2013 Friar et al.
8,606,249 B1 12/2013 Goodwin
8,615,392 B1 12/2013 Goodwin
8,615,394 B1 12/2013 Avendano et al.
8,639,516 B2 1/2014 Lindahl et al.
8,694,310 B2 4/2014 Taylor
8,705,759 B2 4/2014 Wolff et al.
8,744,844 B2 6/2014 Klein
8,750,526 B1 6/2014 Santos et al.
8,774,423 B1 7/2014 Solbach
8,798,290 B1 8/2014 Choi et al.
8,831,937 B2 9/2014 Murgia et al.
8,880,396 B1 11/2014 Laroche et al.
8,903,721 B1 12/2014 Cowan
8,908,882 B2 12/2014 Goodwin et al.
8,934,641 B2 1/2015 Avendano et al.
8,989,401 B2 3/2015 Ojanpera
9,007,416 B1 4/2015 Murgia et al.
9,094,496 B2 7/2015 Teutsch
9,185,487 B2 * 11/2015 Solbach ..... H04R 3/005
9,197,974 B1 11/2015 Clark et al.
9,210,503 B2 12/2015 Avendano et al.
9,247,192 B2 1/2016 Lee et al.
9,368,110 B1 * 6/2016 Hershey ..... G10L 25/51
9,558,755 B1 * 1/2017 Laroche ..... G10L 21/02
2001/0041976 A1 11/2001 Taniguchi et al.
2002/0041678 A1 4/2002 Basburg-Ertem et al.
2002/0071342 A1 6/2002 Marple et al.

(56) References Cited

U.S. PATENT DOCUMENTS

2002/0097884 A1 7/2002 Cairns
2002/0138263 A1 9/2002 Deligne et al.
2002/0160751 A1 10/2002 Sun et al.
2002/0177995 A1 11/2002 Walker
2003/0023430 A1 1/2003 Wang et al.
2003/0056220 A1 3/2003 Thornton et al.
2003/0093279 A1 5/2003 Malah et al.
2003/0099370 A1 5/2003 Moore
2003/0118200 A1 6/2003 Beaucoup et al.
2003/0147538 A1 8/2003 Elko
2003/0177006 A1 9/2003 Ichikawa et al.
2003/0179888 A1 9/2003 Burnett et al.
2003/0228019 A1 12/2003 Eichler et al.
2004/0066940 A1 4/2004 Amir
2004/0076190 A1 4/2004 Goel et al.
2004/0083110 A1 4/2004 Wang
2004/0102967 A1 5/2004 Furuta et al.
2004/0133421 A1 7/2004 Burnett et al.
2004/0145871 A1 7/2004 Lee
2004/0165736 A1 8/2004 Hetherington et al.
2004/0184882 A1 9/2004 Cosgrove
2005/0008169 A1 1/2005 Muren et al.
2005/0008179 A1 1/2005 Quinn
2005/0043959 A1 2/2005 Stemerdink et al.
2005/0080616 A1 4/2005 Leung et al.
2005/0096904 A1 5/2005 Taniguchi et al.
2005/0114123 A1 5/2005 Lukac et al.
2005/0143989 A1 6/2005 Jelinek
2005/0213739 A1 9/2005 Rodman et al.
2005/0240399 A1 10/2005 Makinen
2005/0249292 A1 11/2005 Zhu
2005/0261896 A1 11/2005 Schuijers et al.
2005/0267369 A1 12/2005 Lazenby et al.
2005/0276363 A1 12/2005 Joublin et al.
2005/0281410 A1 12/2005 Grosvenor et al.
2005/0283544 A1 12/2005 Yee
2006/0063560 A1 3/2006 Herle
2006/0092918 A1 5/2006 Talalai
2006/0100868 A1 5/2006 Hetherington et al.
2006/0122832 A1 6/2006 Takiguchi et al.
2006/0136203 A1 6/2006 Ichikawa
2006/0198542 A1 9/2006 Benjelloun Touimi et al.
2006/0206320 A1 9/2006 Li
2006/0224382 A1 10/2006 Taneda
2006/0242071 A1 10/2006 Stebbings
2006/0270468 A1 11/2006 Hui et al.
2006/0282263 A1 12/2006 Vos et al.
2006/0293882 A1 12/2006 Giesbrecht et al.
2007/0003097 A1 1/2007 Langberg et al.
2007/0005351 A1 1/2007 Sathyendra et al.
2007/0025562 A1 2/2007 Zalewski et al.
2007/0033020 A1 2/2007 (Kelleher) Francois et al.
2007/0033494 A1 2/2007 Wenger et al.
2007/0038440 A1 2/2007 Sung et al.
2007/0041589 A1 2/2007 Patel et al.
2007/0058822 A1 3/2007 Ozawa
2007/0064817 A1 3/2007 Dunne et al.
2007/0067166 A1 3/2007 Pan et al.
2007/0081075 A1 4/2007 Canova et al.
2007/0088544 A1 4/2007 Acero et al.
2007/0100612 A1 5/2007 Ekstrand et al.
2007/0127668 A1 6/2007 Ahya et al.
2007/0136056 A1 6/2007 Moogi et al.
2007/0136059 A1 6/2007 Gadbois
2007/0150268 A1 6/2007 Acero et al.
2007/0154031 A1 7/2007 Avendano et al.
2007/0185587 A1 8/2007 Kondo
2007/0198254 A1 8/2007 Goto et al.
2007/0237271 A1 10/2007 Pessoa et al.
2007/0244695 A1 10/2007 Manjunath et al.
2007/0253574 A1 11/2007 Soulodre
2007/0276656 A1 11/2007 Solbach et al.
2007/0282604 A1 12/2007 Gartner et al.
2007/0287490 A1 12/2007 Green et al.
2008/0019548 A1 1/2008 Avendano
2008/0069366 A1 3/2008 Soulodre
2008/0111734 A1 5/2008 Fam et al.
2008/0117901 A1 5/2008 Klammer
2008/0118082 A1 5/2008 Seltzer et al.
2008/0140396 A1 6/2008 Grosse-Schulte et al.
2008/0159507 A1 7/2008 Virolainen et al.
2008/0160977 A1 7/2008 Ahmaniemi et al.
2008/0187143 A1 8/2008 Mak-Fan
2008/0192955 A1 8/2008 Merks
2008/0192956 A1 8/2008 Kazama
2008/0195384 A1 8/2008 Jabri et al.
2008/0208575 A1 8/2008 Laaksonen et al.
2008/0212795 A1 9/2008 Goodwin et al.
2008/0233934 A1 9/2008 Diethom
2008/0247567 A1 10/2008 Kjolerbakken et al.
2008/0259731 A1 10/2008 Happonen
2008/0298571 A1 12/2008 Kurtz et al.
2008/0304677 A1 12/2008 Abolfathi et al.
2008/0310646 A1 12/2008 Amada
2008/0317259 A1 12/2008 Zhang et al.
2008/0317261 A1 12/2008 Yoshida et al.
2009/0012783 A1 1/2009 Klein
2009/0012784 A1 1/2009 Murgia et al.
2009/0018828 A1 1/2009 Nakadai et al.
2009/0034755 A1 2/2009 Short et al.
2009/0048824 A1 2/2009 Amada
2009/0060222 A1 3/2009 Jeong et al.
2009/0063143 A1 3/2009 Schmidt et al.
2009/0070118 A1 3/2009 Den Brinker et al.
2009/0086986 A1 4/2009 Schmidt et al.
2009/0089054 A1 4/2009 Wang et al.
2009/0106021 A1 4/2009 Zurek et al.
2009/0112579 A1 4/2009 Li et al.
2009/0116656 A1 5/2009 Lee et al.
2009/0119096 A1 5/2009 Gerl et al.
2009/0119099 A1 5/2009 Lee et al.
2009/0134829 A1 5/2009 Baumann et al.
2009/0141908 A1 6/2009 Jeong et al.
2009/0144053 A1 6/2009 Tamura et al.
2009/0144058 A1 6/2009 Sorin
2009/0147942 A1 6/2009 Culter
2009/0150149 A1 6/2009 Culter et al.
2009/0164905 A1 6/2009 Ko
2009/0192790 A1 7/2009 Ei-Maleh et al.
2009/0192791 A1 7/2009 El-Maleh et al.
2009/0204413 A1 8/2009 Sintes et al.
2009/0216526 A1 8/2009 Schmidt et al.
2009/0226005 A1 9/2009 Acero et al.
2009/0226010 A1 9/2009 Schnell et al.
2009/0228272 A1 9/2009 Herbig et al.
2009/0240497 A1 9/2009 Usher et al.
2009/0257609 A1 10/2009 Gerkmann et al.
2009/0262969 A1 10/2009 Short et al.
2009/0264114 A1 10/2009 Virolainen et al.
2009/0287481 A1 11/2009 Paranjpe et al.
2009/0292536 A1 11/2009 Hetherington et al.
2009/0303350 A1 12/2009 Terada
2009/0323655 A1 12/2009 Cardona et al.
2009/0323925 A1 12/2009 Sweeney et al.
2009/0323981 A1 12/2009 Cutler
2009/0323982 A1 12/2009 Solbach et al.
2010/0004929 A1 1/2010 Baik
2010/0017205 A1 1/2010 Visser et al.
2010/0033427 A1 2/2010 Marks et al.
2010/0036659 A1 2/2010 Haulick et al.
2010/0092007 A1 4/2010 Sun
2010/0094643 A1 4/2010 Avendano et al.
2010/0105447 A1 4/2010 Sibbald et al.
2010/0128123 A1 5/2010 DiPoala
2010/0130198 A1 5/2010 Kannappan et al.
2010/0211385 A1 8/2010 Sehlstedt
2010/0215184 A1 8/2010 Buck et al.
2010/0217837 A1 8/2010 Ansari et al.
2010/0228545 A1 9/2010 Ito et al.
2010/0245624 A1 9/2010 Beaucoup
2010/0278352 A1 11/2010 Petit et al.
2010/0280824 A1 11/2010 Petit et al.
2010/0296668 A1 11/2010 Lee et al.
2010/0303298 A1 12/2010 Marks et al.

(56) References Cited

U.S. PATENT DOCUMENTS

| | | | |
|---|---|---|---|
| 2010/0315482 | A1 | 12/2010 | Rosenfeld et al. |
| 2011/0038486 | A1 | 2/2011 | Beaucoup |
| 2011/0038557 | A1 | 2/2011 | Closset et al. |
| 2011/0044324 | A1 | 2/2011 | Li et al. |
| 2011/0075857 | A1 | 3/2011 | Aoyagi |
| 2011/0081024 | A1 | 4/2011 | Soulodre |
| 2011/0081026 | A1 | 4/2011 | Ramakrishnan et al. |
| 2011/0107367 | A1 | 5/2011 | Georgis et al. |
| 2011/0129095 | A1 | 6/2011 | Avendano et al. |
| 2011/0137646 | A1 | 6/2011 | Ahgren et al. |
| 2011/0142257 | A1 | 6/2011 | Goodwin et al. |
| 2011/0173006 | A1 | 7/2011 | Nagel et al. |
| 2011/0173542 | A1 | 7/2011 | Imes et al. |
| 2011/0182436 | A1 | 7/2011 | Murgia et al. |
| 2011/0184732 | A1 | 7/2011 | Godavarti |
| 2011/0184734 | A1 | 7/2011 | Wang et al. |
| 2011/0191101 | A1 | 8/2011 | Uhle et al. |
| 2011/0208520 | A1 | 8/2011 | Lee |
| 2011/0224994 | A1 | 9/2011 | Norvell et al. |
| 2011/0257965 | A1 | 10/2011 | Hardwick |
| 2011/0257967 | A1 | 10/2011 | Every et al. |
| 2011/0264449 | A1 | 10/2011 | Sehlstedt |
| 2011/0280154 | A1 | 11/2011 | Silverstrim et al. |
| 2011/0286605 | A1 | 11/2011 | Furuta et al. |
| 2011/0300806 | A1 | 12/2011 | Lindahl et al. |
| 2011/0305345 | A1 | 12/2011 | Bouchard et al. |
| 2012/0027217 | A1 | 2/2012 | Jun et al. |
| 2012/0050582 | A1 | 3/2012 | Seshadri et al. |
| 2012/0062729 | A1 | 3/2012 | Hart et al. |
| 2012/0116758 | A1 | 5/2012 | Murgia et al. |
| 2012/0116769 | A1* | 5/2012 | Malah ..... G10L 21/038 704/262 |
| 2012/0123775 | A1 | 5/2012 | Murgia et al. |
| 2012/0133728 | A1 | 5/2012 | Lee |
| 2012/0182429 | A1 | 7/2012 | Forutanpour et al. |
| 2012/0202485 | A1 | 8/2012 | Mirbaha et al. |
| 2012/0209611 | A1 | 8/2012 | Furuta et al. |
| 2012/0231778 | A1 | 9/2012 | Chen et al. |
| 2012/0249785 | A1 | 10/2012 | Sudo et al. |
| 2012/0250882 | A1 | 10/2012 | Mohammad et al. |
| 2012/0257778 | A1 | 10/2012 | Hall et al. |
| 2013/0034243 | A1 | 2/2013 | Yermeche et al. |
| 2013/0051543 | A1 | 2/2013 | McDysan et al. |
| 2013/0182857 | A1 | 7/2013 | Namba et al. |
| 2013/0289988 | A1 | 10/2013 | Fry |
| 2013/0289996 | A1 | 10/2013 | Fry |
| 2013/0322461 | A1 | 12/2013 | Poulsen |
| 2013/0332156 | A1 | 12/2013 | Tackin et al. |
| 2013/0332171 | A1* | 12/2013 | Avendano ..... G10L 19/12 704/264 |
| 2013/0343549 | A1 | 12/2013 | Vemireddy et al. |
| 2014/0003622 | A1 | 1/2014 | Ikizyan et al. |
| 2014/0350926 | A1 | 11/2014 | Schuster et al. |
| 2014/0379348 | A1* | 12/2014 | Sung ..... G10L 25/75 704/254 |
| 2015/0025881 | A1 | 1/2015 | Carlos et al. |
| 2015/0078555 | A1 | 3/2015 | Zhang et al. |
| 2015/0078606 | A1 | 3/2015 | Zhang et al. |
| 2015/0208165 | A1 | 7/2015 | Volk et al. |
| 2016/0037245 | A1 | 2/2016 | Harrington |
| 2016/0061934 | A1 | 3/2016 | Woodruff et al. |
| 2016/0078880 | A1* | 3/2016 | Avendano ..... G10L 21/02 704/202 |
| 2016/0093307 | A1 | 3/2016 | Warren et al. |
| 2016/0094910 | A1 | 3/2016 | Vallabhan et al. |

FOREIGN PATENT DOCUMENTS

| | | | |
|---|---|---|---|
| EP | 1081685 | A2 | 3/2001 |
| EP | 1536660 | | 6/2005 |
| FI | 20080623 | A | 11/2008 |
| FI | 20110428 | A | 12/2011 |
| FI | 20125600 | | 6/2012 |
| FI | 123080 | B | 10/2012 |
| JP | H05172865 | A | 7/1993 |
| JP | H05300419 | | 11/1993 |
| JP | H07336793 | | 12/1995 |
| JP | 2004053895 | A | 2/2004 |
| JP | 2004531767 | A | 10/2004 |
| JP | 2004533155 | A | 10/2004 |
| JP | 2005148274 | A | 6/2005 |
| JP | 2005518118 | A | 6/2005 |
| JP | 2005309096 | A | 11/2005 |
| JP | 2006515490 | | 5/2006 |
| JP | 2007201818 | | 8/2007 |
| JP | 2008518257 | A | 5/2008 |
| JP | 2008542798 | | 11/2008 |
| JP | 2009037042 | | 2/2009 |
| JP | 2009538450 | A | 11/2009 |
| JP | 2012514233 | A | 6/2012 |
| JP | 5081903 | B2 | 9/2012 |
| JP | 2013513306 | | 4/2013 |
| JP | 2013527479 | A | 6/2013 |
| JP | 5718251 | B2 | 3/2015 |
| JP | 5855571 | B2 | 12/2015 |
| KR | 1020070068270 | | 6/2007 |
| KR | 101050379 | B1 | 12/2008 |
| KR | 1020080109048 | | 12/2008 |
| KR | 1020090013221 | | 2/2009 |
| KR | 1020110111409 | | 10/2011 |
| KR | 1020120094892 | | 8/2012 |
| KR | 1020120101457 | | 9/2012 |
| KR | 101294634 | B1 | 8/2013 |
| KR | 101610662 | B1 | 4/2016 |
| TW | 519615 | B | 2/2003 |
| TW | 200847133 | A | 12/2008 |
| TW | 201113873 | A | 4/2011 |
| TW | 201143475 | | 12/2011 |
| TW | I421858 | B | 1/2014 |
| TW | 201513099 | A | 4/2015 |
| WO | WO1984000634 | | 2/1984 |
| WO | WO2002007061 | | 1/2002 |
| WO | WO2002080362 | | 10/2002 |
| WO | WO2002103676 | | 12/2002 |
| WO | WO2003069499 | | 8/2003 |
| WO | WO2004010415 | A1 | 1/2004 |
| WO | WO2005086138 | A1 | 9/2005 |
| WO | WO2007140003 | A2 | 12/2007 |
| WO | WO2008034221 | | 3/2008 |
| WO | WO2010077361 | A1 | 7/2010 |
| WO | WO2011002489 | A1 | 1/2011 |
| WO | WO2011068901 | | 6/2011 |
| WO | WO2012094422 | A2 | 7/2012 |
| WO | WO2013188562 | | 12/2013 |
| WO | WO2015010129 | A1 | 1/2015 |
| WO | WO2016040885 | A1 | 3/2016 |
| WO | WO2016049566 | A1 | 3/2016 |

OTHER PUBLICATIONS

Non-Final Office Action, dated Jan. 21, 2009, U.S. Appl. No. 11/441,675, filed May 25, 2006.

Final Office Action, dated Sep. 3, 2009, U.S. Appl. No. 11/441,675, filed May 25, 2006.

Non-Final Office Action, dated May 10, 2011, U.S. Appl. No. 11/441,675, filed May 25, 2006.

Final Office Action, dated Oct. 24, 2011, U.S. Appl. No. 11/441,675, filed May 25, 2006.

Notice of Allowance, dated Feb. 13, 2012, U.S. Appl. No. 11/441,675, filed May 25, 2006.

Non-Fianl Office Action, dated Dec. 6, 2011, U.S. Appl. No. 12/319,107, filed Dec. 31, 2008.

Final Office Action, dated Apr. 16, 2012, U.S. Appl. No. 12/319,107, filed Dec. 31, 2008.

Advisory Action, dated Jun. 28, 2012, U.S. Appl. No. 12/319,107, filed Dec. 31, 2008.

Non-Final Office Action, dated Jan. 3, 2014, U.S. Appl. No. 12/319,107, filed Dec. 31, 2008.

Notice of Allowance, dated Aug. 25, 2014, U.S. Appl. No. 12/319,107, filed Dec. 31, 2008.

(56) References Cited

OTHER PUBLICATIONS

Non-Final Office Action, dated Dec. 10, 2012, U.S. Appl. No. 12/493,927, filed Jun. 29, 2009.
Final Office Action, dated May 14, 2013, U.S. Appl. No. 12/493,927, filed Jun. 29, 2009.
Non-Final Office Action, dated Jan. 9, 2014, U.S. Appl. No. 12/493,927, filed Jun. 29, 2009.
Notice of Allowance, dated Aug. 20, 2014, U.S. Appl. No. 12/493,927, filed Jun. 29, 2009.
Non-Final Office Action, dated Aug. 28, 2012, U.S. Appl. No. 12/860,515, filed Aug. 20, 2010.
Final Office Action, dated Mar. 11, 2013, U.S. Appl. No. 12/860,515, filed Aug. 20, 2010.
Non-Final Office Action, dated Aug. 28, 2013, U.S. Appl. No. 12/860,515, filed Aug. 20, 2010.
Notice of Allowance, dated Jun. 18, 2014, U.S. Appl. No. 12/860,515, filed Aug. 20, 2010.
Non-Final Office Action, dated Oct. 2, 2012, U.S. Appl. No. 12/906,009, filed Oct. 15, 2010.
Non-Final Office Action, dated Jul. 2, 2013, U.S. Appl. No. 12/906,009, filed Oct. 15, 2010.
Final Office Action, dated May 7, 2014, U.S. Appl. No. 12/906,009, filed Oct. 15, 2010.
Non-Final Office Action, dated Apr. 21, 2015, U.S. Appl. No. 12/906,009, filed Oct. 15, 2010.
Non-Final Office Action, dated Jul. 31, 2013, U.S. Appl. No. 13/009,732, filed Jan. 19, 2011.
Final Office Action, dated Dec. 16, 2014, U.S. Appl. No. 13/009,732, filed Jan. 19, 2011.
Non-Final Office Action, dated Apr. 24, 2013, U.S. Appl. No. 13/012,517, filed Jan. 24, 2011.
Final Office Action, dated Dec. 3, 2013, U.S. Appl. No. 13/012,517, filed Jan. 24, 2011.
Non-Final Office Action, dated Nov. 19, 2014, U.S. Appl. No. 13/012,517, filed Jan. 24, 2011.
Final Office Action, dated Jun. 17, 2015, U.S. Appl. No. 13/012,517, filed Jan. 24, 2011.
Non-Final Office Action, dated Feb. 21, 2012, U.S. Appl. No. 13/288,858, filed Nov. 3, 2011.
Notice of Allowance, dated Sep. 10, 2012, U.S. Appl. No. 13/288,858, filed Nov. 3, 2011.
Non-Final Office Action, dated Feb. 14, 2012, U.S. Appl. No. 13/295,981, filed Nov. 14, 2011.
Final Office Action, dated Jul. 9, 2012, U.S. Appl. No. 13/295,981, filed Nov. 14, 2011.
Final Office Action, dated Jul. 17, 2012, U.S. Appl. No. 13/295,981, filed Nov. 14, 2011.
Advisory Action, dated Sep. 24, 2012, U.S. Appl. No. 13/295,981, filed Nov. 14, 2011.
Notice of Allowance, dated May 9, 2014, U.S. Appl. No. 13/295,981, filed Nov. 14, 2011.
Non-Final Office Action, dated Feb. 1, 2016, U.S. Appl. No. 14/335,850, filed Jul. 18, 2014.
Office Action dated Jan. 30, 2015 in Finland Patent Application No. 20080623, filed May 24, 2007.
Office Action dated Mar. 27, 2015 in Korean Patent Application No. 10-2011-7016591, filed Dec. 30, 2009.
Notice of Allowance dated Aug. 13, 2015 in Finnish Patent Application 20080623, filed May 24, 2007.
Office Action dated Oct. 15, 2015 in Korean Patent Application 10-2011-7016591.
Notice of Allowance dated Jan. 14, 2016 in South Korean Patent Application No. 10-2011-7016591 filed Jul. 15, 2011.
International Search Report & Written Opinion dated Feb. 12, 2016 in Patent Cooperation Treaty Application No. PCT/US2015/064523, filed Dec. 8, 2015.
International Search Report & Written Opinion dated Feb. 11, 2016 in Patent Cooperation Treaty Application No. PCT/US2015/063519, filed Dec. 2, 2015.
Klein, David, "Noise-Robust Multi-Lingual Keyword Spotting with a Deep Neural Network Based Architecture", U.S. Appl. No. 14/614,348, filed Feb. 4, 2015.
Vitus, Deborah Kathleen et al., "Method for Modeling User Possession of Mobile Device for User Authentication Framework", U.S. Appl. No. 14/548,207, filed Nov. 19, 2014.
Murgia, Carlo, "Selection of System Parameters Based on Non-Acoustic Sensor Information", U.S. Appl. No. 14/331,205, filed Jul. 14, 2014.
Goodwin, Michael M. et al., "Key Click Suppression", U.S. Appl. No. 14/745,176, filed Jun. 19, 2015.
Boll, Steven F. "Suppression of Acoustic Noise in Speech using Spectral Subtraction", IEEE Transactions on Acoustics, Speech and Signal Processing, vol. ASSP-27, No. 2, Apr. 1979, pp. 113-120.
"ENT 172." Instructional Module. Prince George's Community College Department of Engineering Technology Accessed: Oct. 15, 2011. Subsection: "Polar and Rectangular Notation". <http://academic.ppgcc.edu/ent/ent172_instr_mod.html>.
Fulghum, D. P. et al., "LPC Voice Digitizer with Background Noise Suppression", 1979 IEEE International Conference on Acoustics, Speech, and Signal Processing, pp. 220-223.
Haykin, Simon et al., "Appendix A.2 Complex Numbers." Signals and Systems. 2nd Ed. 2003. p. 764.
Hohmann, V. "Frequency Analysis and Synthesis Using a Gammatone Filterbank", ACTA Acustica United with Acustica, 2002, vol. 88, pp. 433-442.
Martin, Rainer "Spectral Subtraction Based on Minimum Statistics", in Proceedings Europe. Signal Processing Conf., 1994, pp. 1182-1185.
Mitra, Sanjit K. Digital Signal Processing: a Computer-based Approach. 2nd Ed. 2001. pp. 131-133.
Cosi, Piero et al., (1996), "Lyon's Auditory Model Inversion: a Tool for Sound Separation and Speech Enhancement," Proceedings of ESCA Workshop on 'The Auditory Basis of Speech Perception,' Keele University, Keele (UK), Jul. 15-19, 1996, pp. 194-197.
Rabiner, Lawrence R. et al., "Digital Processing of Speech Signals", (Prentice-Hall Series in Signal Processing). Upper Saddle River, NJ: Prentice Hall, 1978.
Schimmel, Steven et al., "Coherent Envelope Detection for Modulation Filtering of Speech," 2005 IEEE International Conference on Acoustics, Speech, and Signal Processing, vol. 1, No. 7, pp. 221-224.
Slaney, Malcom, et al., "Auditory Model Inversion for Sound Separation," 1994 IEEE International Conference on Acoustics, Speech and Signal Processing, Apr. 19-22, vol. 2, pp. 77-80.
Slaney, Malcom. "An Introduction to Auditory Model Inversion", Interval Technical Report IRC 1994-014, http://coweb.ecn.purdue.edu/~maclom/interval/1994-014/, Sep. 1994, accessed on Jul. 6, 2010.
Solbach, Ludger "An Architecture for Robust Partial Tracking and Onset Localization in Single Channel Audio Signal Mixes", Technical University Hamburg—Harburg, 1998.
International Search Report and Written Opinion dated Sep. 16, 2008 in Patent Cooperation Treaty Application No. PCT/US2007/012628.
International Search Report and Written Opinion dated May 20, 2010 in Patent Cooperation Treaty Application No. PCT/US2009/006754.
Fast Cochlea Transform, US Trademark Reg. No. 2,875,755 (Aug. 17, 2004).
3GPP2 "Enhanced Variable Rate Codec, Speech Service Options 3, 68, 70, and 73 for Wideband Spread Spectrum Digital Systems", May 2009, pp. 1-308.
3GPP2 "Selectable Mode Vocoder (SMV) Service Option for Wideband Spread Spectrum Communication Systems", Jan. 2004, pp. 1-231.
3GPP2 "Source-Controlled Variable-Rate Multimode Wideband Speech Codec (VMR-WB) Service Option 62 for Spread Spectrum Systems", Jun. 11, 2004, pp. 1-164.
3GPP "3GPP Specification 26.071 Mandatory Speech Codec Speech Processing Functions; AMR Speech Codec; General Description", http://www.3gpp.org/ftp/Specs/html-info/26071.htm, accessed on Jan. 25, 2012.

(56) References Cited

OTHER PUBLICATIONS

3GPP "3GPP Specification 26.094 Mandatory Speech Codec Speech Processing Functions; Adaptive Multi-Rate (AMR) Speech Codec; Voice Activity Detector (VAD)", http://www.3gpp.org/ftp/Specs/html-info/26094.htm, accessed on Jan. 25, 2012.
3GPP "3GPP Specification 26.171 Speech Codec Speech Processing Functions; Adaptive Multi-Rate—Wideband (AMR-WB) Speech Codec; General Description", http://www.3gpp.org/ftp/Specs/html-info26171.htm, accessed on Jan. 25, 2012.
3GPP "3GPP Specification 26.194 Speech Codec Speech Processing Functions; Adaptive Multi-Rate—Wideband (AMR-WB) Speech Codec; Voice Activity Detector (VAD)" http://www.3gpp.org/ftp/Specs/html-info26194.htm, accessed on Jan. 25, 2012.
International Telecommunication Union "Coding of Speech at 8 kbit/s Using Conjugate-Structure Algebraic-code-excited Linear-prediction (CS-ACELP)", Mar. 19, 1996, pp. 1-39.
International Telecommunication Union "Coding of Speech at 8 kbit/s Using Conjugate Structure Algebraic-code-excited Linear-prediction (CS-ACELP) Annex B: A Silence Compression Scheme for G.729 Optimized for Terminals Conforming to Recommendation V.70", Nov. 8, 1996, pp. 1-23.
International Search Report and Written Opinion dated Aug. 19, 2010 in Patent Cooperation Treaty Application No. PCT/US2010/001786.
Cisco, "Understanding How Digital T1 CAS (Robbed Bit Signaling) Works in IOS Gateways", Jan. 17, 2007, http://www.cisco.com/image/gif/paws/22444/t1-cas-ios.pdf, accessed on Apr. 3, 2012.
Jelinek et al., "Noise Reduction Method for Wideband Speech Coding" Proc. Eusipco, Vienna, Austria, Sep. 2004, pp. 1959-1962.
Widjaja et al., "Application of Differential Microphone Array for IS-127 EVRC Rate Determination Algorithm", Interspeech 2009, 10th Annual Conference of the International Speech Communication Association, Brighton, United Kingdom Sep. 6-10, 2009, pp. 1123-1126.
Sugiyama et al., "Single-Microphone Noise Suppression for 3G Handsets Based on Weighted Noise Estimation" in Benesty et al., "Speech Enhancement", 2005, pp. 115-133, Springer Berlin Heidelberg.
Watts, "Real-Time, High-Resolution Simulation of the Auditory Pathway, with Application to Cell-Phone Noise Reduction" Proceedings of 2010 IEEE International Symposium on Circuits and Systems (ISCAS), May 30-Jun. 2, 2010, pp. 3821-3824.
3GPP Minimum Performance Specification for the Enhanced Variable rate Codec, Speech Service Option 3 and 68 for Wideband Spread Spectrum Digital Systems, Jul. 2007, pp. 1-83.
Ramakrishnan, 2000. Reconstruction of Incomplete Spectrograms for robust speech recognition. PHD thesis, Carnegie Mellon University, Pittsburgh, Pennsylvania.
Kim et al., "Missing-Feature Reconstruction by Leveraging Temporal Spectral Correlation for Robust Speech Recognition in Background Noise Conditions, "Audio, Speech, and Language Processing, IEEE Transactions on, vol. 18, No. 8 pp. 2111-2120, Nov. 2010.
Cooke et al.,"Robust Automatic Speech Recognition with Missing and Unreliable Acoustic data," Speech Commun., vol. 34, No. 3, pp. 267-285, 2001.
Liu et al., "Efficient cepstral normalization for robust speech recognition." Proceedings of the workshop on Human Language Technology. Association for Computational Linguistics, 1993.
Yoshizawa et al., "Cepstral gain normalization for noise robust speech recognition." Acoustics, Speech, and Signal Processing, 2004. Proceedings, (ICASSP04), IEEE International Conference on vol. 1 IEEE, 2004.
Office Action dated Apr. 8, 2014 in Japan Patent Application 2011-544416, filed Dec. 30, 2009.
Elhilali et al.,"A cocktail party with a cortical twist: How cortical mechanisms contribute to sound segregation." J Acoust Soc Am. Dec. 2008; 124(6): 3751-3771).
Jin et al., "HMM-Based Multipitch Tracking for Noisy and Reverberant Speech." Jul. 2011.
Kawahara, W., et al., "Tandem-Straight: A temporally stable power spectral representation for periodic signals and applications to interference-free spectrum, F0, and aperiodicity estimation." IEEE ICASSP 2008.
Lu et al. "A Robust Audio Classification and Segmentation Method." Microsoft Research, 2001, pp. 203, 206, and 207.
International Search Report & Written Opinion dated Nov. 12, 2014 in Patent Cooperation Treaty Application No. PCT/US2014/047458, filed Jul. 21, 2014.
Krini, Mohamed et al., "Model-Based Speech Enhancement," in Speech and Audio Processing in Adverse Environments; Signals and Communication Technology, edited by Hansler et al., 2008, Chapter 4, pp. 89-134.
Office Action dated Dec. 9, 2014 in Japan Patent Application No. 2012-518521, filed Jun. 21, 2010.
Office Action dated Dec. 10, 2014 in Taiwan Patent Application No. 099121290, filed Jun. 29, 2010.
Purnhagen, Heiko, "Low Complexity Parametric Stereo Coding in MPEG-4," Proc. Of the 7th Int. Conference on Digital Audio Effects (DAFx'04), Naples, Italy, Oct. 5-8, 2004.
Chang, Chun-Ming et al., "Voltage-Mode Multifunction Filter with Single Input and Three Outputs Using Two Compound Current Conveyors" IEEE Transactions on Circuits and Systems—I: Fundamental Theory and Applications, vol. 46, No. 11, Nov. 1999.
Nayebi et al., "Low delay FIR filter banks: design and evaluation" IEEE Transactions on Signal Processing, vol. 42, No. 1, pp. 24-31, Jan. 1994.
Notice of Allowance dated Feb. 17, 2015 in Japan Patent Application No. 2011-544416, filed Dec. 30, 2009.
International Search Report and Written Opinion dated Feb. 7, 2011 in Patent Cooperation Treaty Application No. PCT/US10/58600.
International Search Report dated Dec. 20, 2013 in Patent Cooperation Treaty Application No. PCT/US2013/045462, filed Jun. 12, 2013.
Office Action dated Aug. 26, 2014 in Japanese Application No. 2012-542167, filed Dec. 1, 2010.
Office Action dated Oct. 31, 2014 in Finnish Patent Application No. 20125600, filed Jun. 1, 2012.
Office Action dated Jul. 21, 2015 in Japanese Patent Application 2012-542167 filed Dec. 1, 2010.
Office Action dated Sep. 29, 2015 in Finnish Patent Application 20125600, filed Dec. 1, 2010.
Allowance dated Nov. 17, 2015 in Japanese Patent Application 2012-542167, filed Dec. 1, 2010.
International Search Report & Written Opinion dated Dec. 14, 2015 in Patent Cooperation Treaty Application No. PCT/US2015/049816, filed Sep. 11, 2015.
International Search Report & Written Opinion dated Dec. 22, 2015 in Patent Cooperation Treaty Application No. PCT/US2015/052433, filed Sep. 25, 2015.

* cited by examiner

SYSTEMS AND METHODS FOR RESTORATION OF SPEECH COMPONENTS

CROSS-REFERENCE TO RELATED APPLICATION

The present application claims the benefit of U.S. Provisional Application No. 62/049,988, filed on Sep. 12, 2014. The subject matter of the aforementioned application is incorporated herein by reference for all purposes.

FIELD

The present application relates generally to audio processing and, more specifically, to systems and methods for restoring distorted speech components of a noise-suppressed audio signal.

BACKGROUND

Noise reduction is widely used in audio processing systems to suppress or cancel unwanted noise in audio signals used to transmit speech. However, after the noise cancellation and/or suppression, speech that is intertwined with noise tends to be overly attenuated or eliminated altogether in noise reduction systems.

There are models of the brain that explain how sounds are restored using an internal representation that perceptually replaces the input via a feedback mechanism. One exemplary model called a convergence-divergence zone (CDZ) model of the brain has been described in neuroscience and, among other things, attempts to explain the spectral completion and phonemic restoration phenomena found in human speech perception.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Systems and methods for restoring distorted speech components of an audio signal are provided. An example method includes determining distorted frequency regions and undistorted frequency regions in the audio signal. The distorted frequency regions include regions of the audio signal in which a speech distortion is present. The method includes performing one or more iterations using a model for refining predictions of the audio signal at the distorted frequency regions. The model can be configured to modify the audio signal.

In some embodiments, the audio signal includes a noise-suppressed audio signal obtained by at least one of noise reduction or noise cancellation of an acoustic signal including speech. The acoustic signal is attenuated or eliminated at the distorted frequency regions.

In some embodiments, the model used to refine predictions of the audio signal at the distorted frequency regions includes a deep neural network trained using spectral envelopes of clean audio signals or undamaged audio signals. The refined predictions can be used for restoring speech components in the distorted frequency regions.

In some embodiments, the audio signals at the distorted frequency regions are set to zero before the first iteration. Prior to performing each of the iterations, the audio signals at the undistorted frequency regions are restored to initial values before the first iterations.

In some embodiments, the method further includes comparing the audio signal at the undistorted frequency regions before and after each of the iterations to determine discrepancies. In certain embodiments, the method allows ending the one or more iterations if the discrepancies meet predetermined criteria. The pre-determined criteria can be defined by low and upper bounds of energies of the audio signal.

According to another example embodiment of the present disclosure, the steps of the method for restoring distorted speech components of an audio signal are stored on a non-transitory machine-readable medium comprising instructions, which when implemented by one or more processors perform the recited steps.

Other example embodiments of the disclosure and aspects will become apparent from the following description taken in conjunction with the following drawings.

BRIEF DESCRIPTION OF THE DRAWINGS

Embodiments are illustrated by way of example and not limitation in the figures of the accompanying drawings, in which like references indicate similar elements.

DETAILED DESCRIPTION

The technology disclosed herein relates to systems and methods for restoring distorted speech components of an audio signal. Embodiments of the present technology may be practiced with any audio device configured to receive and/or provide audio such as, but not limited to, cellular phones, wearables, phone handsets, headsets, and conferencing systems. It should be understood that while some embodiments of the present technology will be described in reference to operations of a cellular phone, the present technology may be practiced with any audio device.

Audio devices can include radio frequency (RF) receivers, transmitters, and transceivers, wired and/or wireless telecommunications and/or networking devices, amplifiers, audio and/or video players, encoders, decoders, speakers, inputs, outputs, storage devices, and user input devices. The audio devices may include input devices such as buttons, switches, keys, keyboards, trackballs, sliders, touchscreens, one or more microphones, gyroscopes, accelerometers, global positioning system (GPS) receivers, and the like. The audio devices may include output devices, such as LED indicators, video displays, touchscreens, speakers, and the like. In some embodiments, mobile devices include wearables and hand-held devices, such as wired and/or wireless remote controls, notebook computers, tablet computers, phablets, smart phones, personal digital assistants, media players, mobile telephones, and the like.

In various embodiments, the audio devices can be operated in stationary and portable environments. Stationary environments can include residential and commercial buildings or structures, and the like. For example, the stationary embodiments can include living rooms, bedrooms, home theaters, conference rooms, auditoriums, business premises, and the like. Portable environments can include moving vehicles, moving persons, other transportation means, and the like.

According to an example embodiment, a method for restoring distorted speech components of an audio signal includes determining distorted frequency regions and undistorted frequency regions in the audio signal. The distorted frequency regions include regions of the audio signal wherein speech distortion is present. The method includes performing one or more iterations using a model for refining predictions of the audio signal at the distorted frequency regions. The model can be configured to modify the audio signal.

Figure 1:
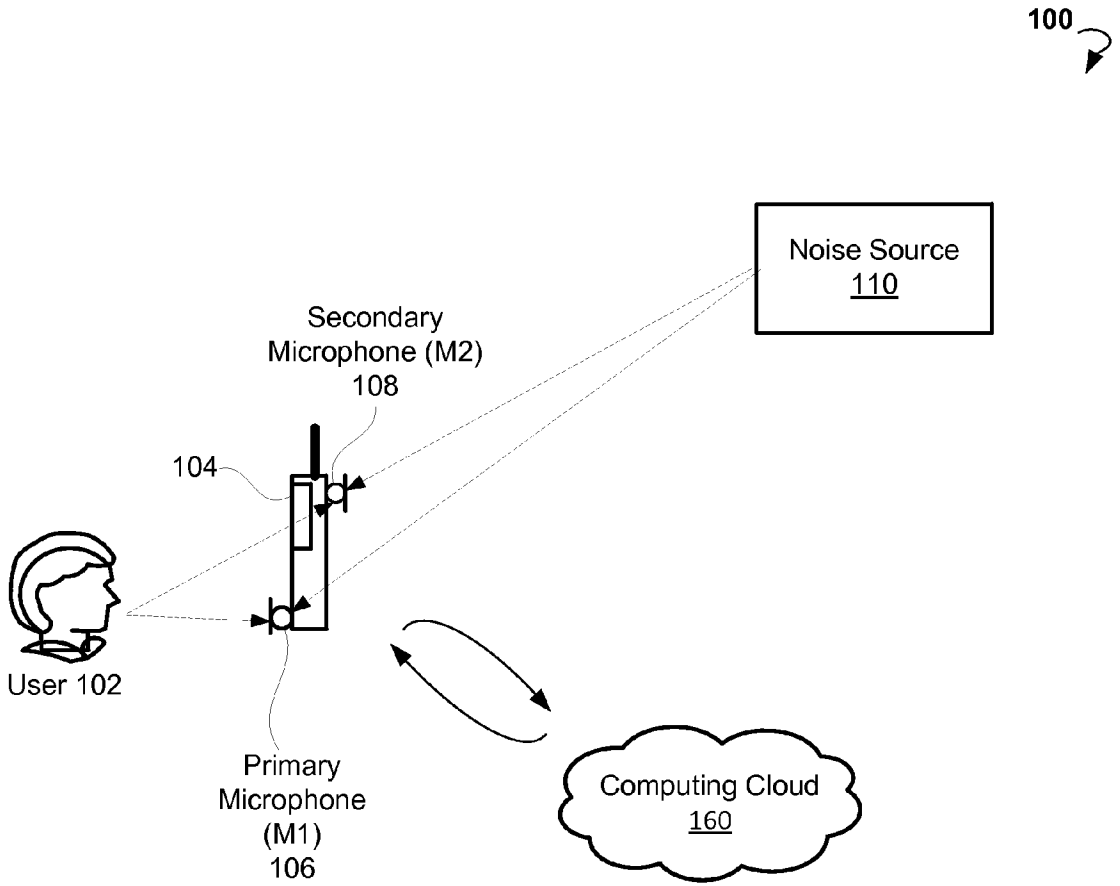
FIG. 1 is a block diagram illustrating an environment in which the present technology may be practiced.

Referring now to FIG. 1, an environment 100 is shown in which a method for restoring distorted speech components of an audio signal can be practiced. The example environment 100 can include an audio device 104 operable at least to receive an audio signal. The audio device 104 is further operable to process and/or record/store the received audio signal.

In some embodiments, the audio device 104 includes one or more acoustic sensors, for example microphones. In example of FIG. 1, audio device 104 includes a primary microphone (M1) 106 and a secondary microphone 108. In various embodiments, the microphones 106 and 108 are used to detect both acoustic audio signal, for example, a verbal communication from a user 102 and a noise 110. The verbal communication can include keywords, speech, singing, and the like.

Noise 110 is unwanted sound present in the environment 100 which can be detected by, for example, sensors such as microphones 106 and 108. In stationary environments, noise sources can include street noise, ambient noise, sounds from a mobile device such as audio, speech from entities other than an intended speaker(s), and the like. Noise 110 may include reverberations and echoes. Mobile environments can encounter certain kinds of noises which arise from their operation and the environments in which they operate, for example, road, track, tire/wheel, fan, wiper blade, engine, exhaust, entertainment system, communications system, competing speakers, wind, rain, waves, other vehicles, exterior, and the like noise. Acoustic signals detected by the microphones 106 and 108 can be used to separate desired speech from the noise 110.

In some embodiments, the audio device 104 is connected to a cloud-based computing resource 160 (also referred to as a computing cloud). In some embodiments, the computing cloud 160 includes one or more server farms/clusters comprising a collection of computer servers and is co-located with network switches and/or routers. The computing cloud 160 is operable to deliver one or more services over a network (e.g., the Internet, mobile phone (cell phone) network, and the like). In certain embodiments, at least partial processing of audio signal is performed remotely in the computing cloud 160. The audio device 104 is operable to send data such as, for example, a recorded acoustic signal, to the computing cloud 160, request computing services and to receive the results of the computation.

Figure 2:
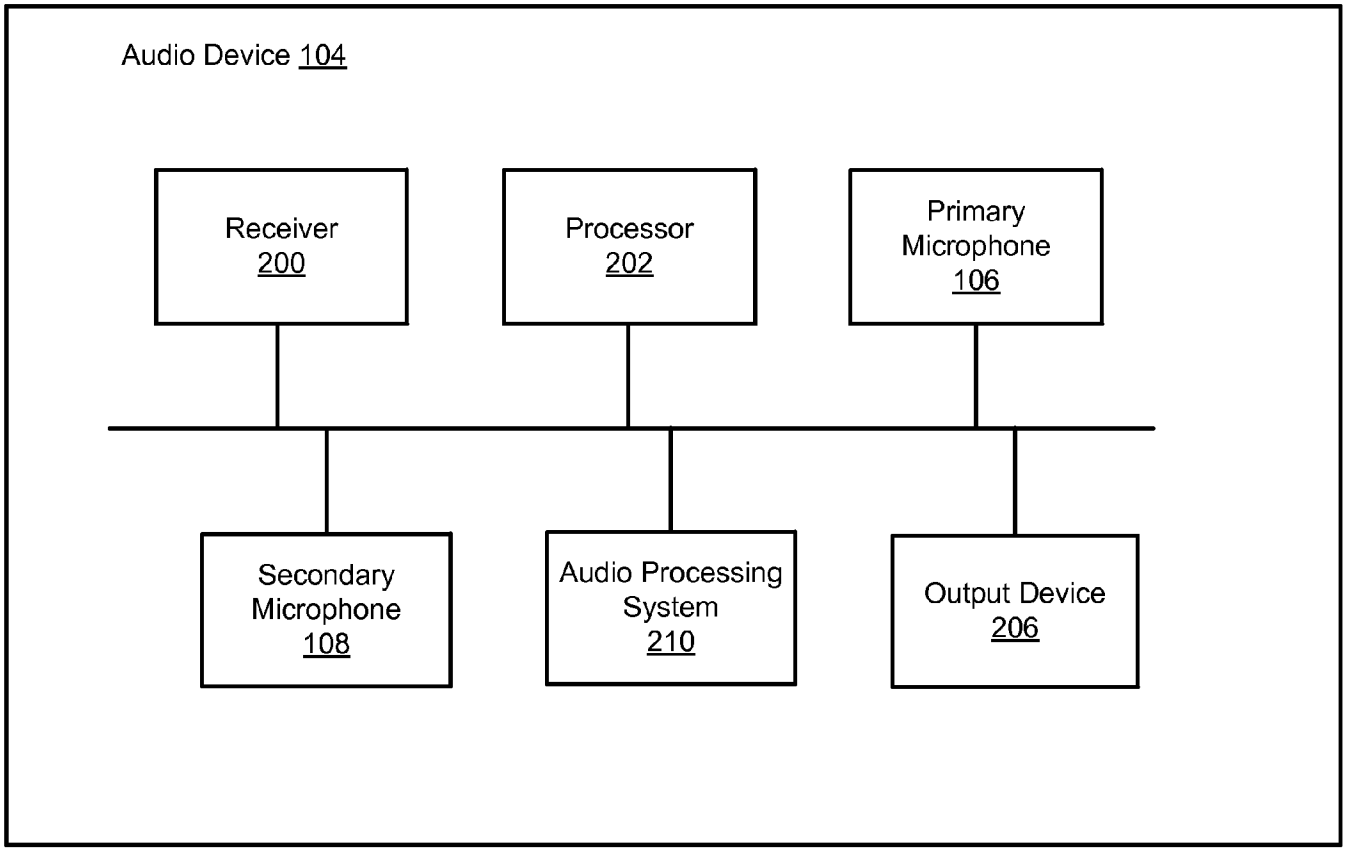
FIG. 2 is a block diagram illustrating an audio device, according to an example embodiment.

FIG. 2 is a block diagram of an example audio device 104. As shown, the audio device 104 includes a receiver 200, a processor 202, the primary microphone 106, the secondary microphone 108, an audio processing system 210, and an output device 206. The audio device 104 may include further or different components as needed for operation of audio device 104. Similarly, the audio device 104 may include fewer components that perform similar or equivalent functions to those depicted in FIG. 2. For example, the audio device 104 includes a single microphone in some embodiments, and two or more microphones in other embodiments.

In various embodiments, the receiver 200 can be configured to communicate with a network such as the Internet, Wide Area Network (WAN), Local Area Network (LAN), cellular network, and so forth, to receive audio signal. The received audio signal is then forwarded to the audio processing system 210.

In various embodiments, processor 202 includes hardware and/or software, which is operable to execute instructions stored in a memory (not illustrated in FIG. 2). The exemplary processor 202 uses floating point operations, complex operations, and other operations, including noise suppression and restoration of distorted speech components in an audio signal.

The audio processing system 210 can be configured to receive acoustic signals from an acoustic source via at least one microphone (e.g., primary microphone 106 and secondary microphone 108 in the examples in FIG. 1 and FIG. 2) and process the acoustic signal components. The microphones 106 and 108 in the example system are spaced a distance apart such that the acoustic waves impinging on the device from certain directions exhibit different energy levels at the two or more microphones. After reception by the microphones 106 and 108, the acoustic signals can be converted into electric signals. These electric signals can, in turn, be converted by an analog-to-digital converter (not shown) into digital signals for processing in accordance with some embodiments.

In various embodiments, where the microphones 106 and 108 are omni-directional microphones that are closely spaced (e.g., 1-2 cm apart), a beamforming technique can be used to simulate a forward-facing and backward-facing directional microphone response. A level difference can be obtained using the simulated forward-facing and backward-facing directional microphone. The level difference can be used to discriminate speech and noise in, for example, the time-frequency domain, which can be used in noise and/or echo reduction. In some embodiments, some microphones are used mainly to detect speech and other microphones are used mainly to detect noise. In various embodiments, some microphones are used to detect both noise and speech.

The noise reduction can be carried out by the audio processing system 210 based on inter-microphone level differences, level salience, pitch salience, signal type classification, speaker identification, and so forth. In various embodiments, noise reduction includes noise cancellation and/or noise suppression.

In some embodiments, the output device 206 is any device which provides an audio output to a listener (e.g., the acoustic source). For example, the output device 206 may comprise a speaker, a class-D output, an earpiece of a headset, or a handset on the audio device 104.

Figure 3:
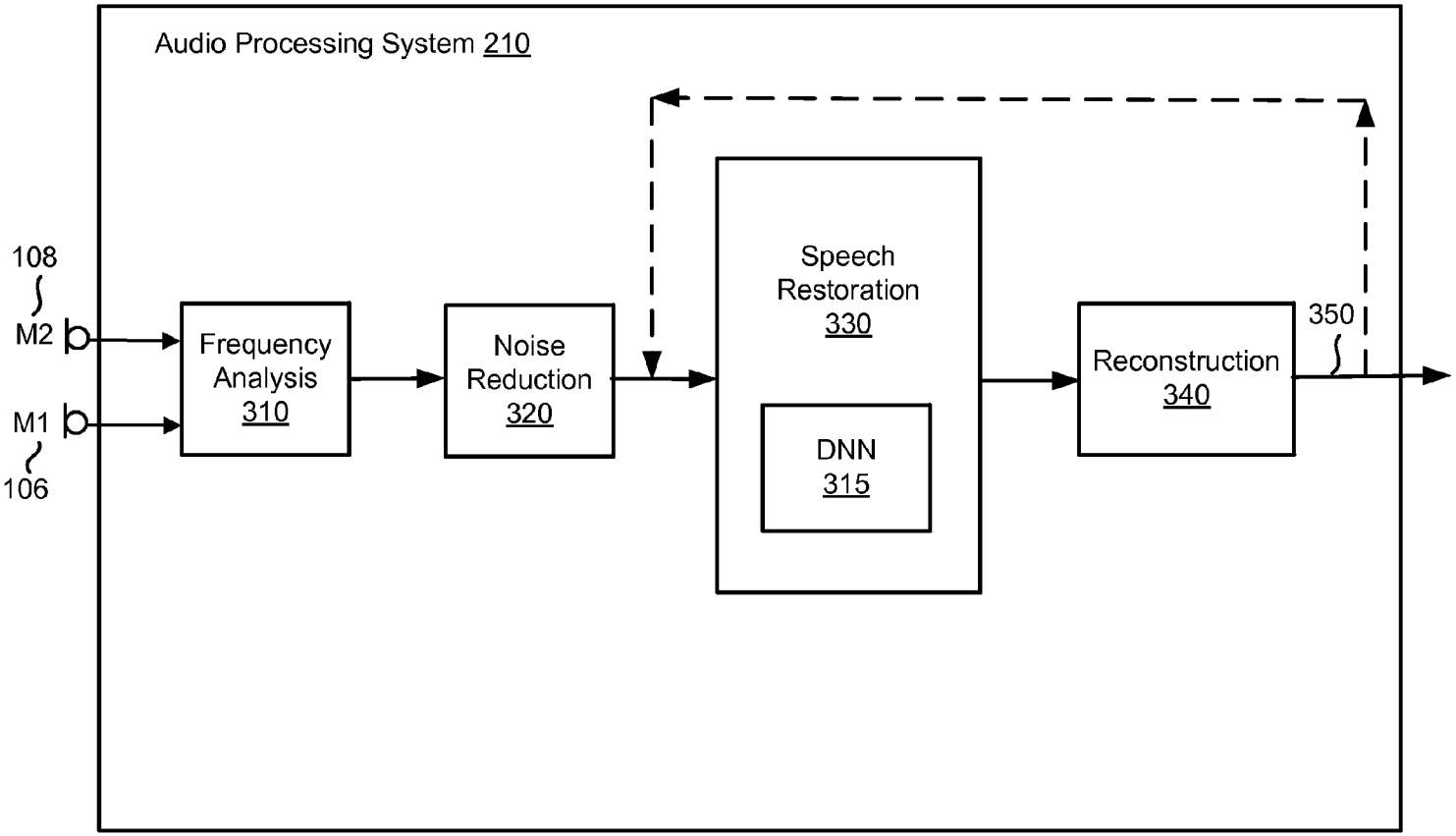
FIG. 3 is a block diagram illustrating modules of an audio processing system, according to an example embodiment.

FIG. 3 is a block diagram showing modules of an audio processing system 210, according to an example embodiment. The audio processing system 210 of FIG. 3 may provide more details for the audio processing system 210 of FIG. 2. The audio processing system 210 includes a frequency analysis module 310, a noise reduction module 320, a speech restoration module 330, and a reconstruction module 340. The input signals may be received from the receiver 200 or microphones 106 and 108.

In some embodiments, audio processing system 210 is operable to receive an audio signal including one or more time-domain input audio signals, depicted in the example in FIG. 3 as being from the primary microphone (M1) and secondary microphones (M2) in FIG. 1. The input audio signals are provided to frequency analysis module 310.

In some embodiments, frequency analysis module 310 is operable to receive the input audio signals. The frequency analysis module 310 generates frequency sub-bands from the time-domain input audio signals and outputs the frequency sub-band signals. In some embodiments, the frequency analysis module 310 is operable to calculate or determine speech components, for example, a spectrum envelope and excitations, of received audio signal.

In various embodiments, noise reduction module 320 includes multiple modules and receives the audio signal from the frequency analysis module 310. The noise reduction module 320 is operable to perform noise reduction in the audio signal to produce a noise-suppressed signal. In some embodiments, the noise reduction includes a subtractive noise cancellation or multiplicative noise suppression. By way of example and not limitation, noise reduction methods are described in U.S. patent application Ser. No. 12/215,980, entitled "System and Method for Providing Noise Suppression Utilizing Null Processing Noise Subtraction," filed Jun. 30, 2008, and in U.S. patent application Ser. No. 11/699,732 (U.S. Pat. No. 8,194,880), entitled "System and Method for Utilizing Omni-Directional Microphones for Speech Enhancement," filed Jan. 29, 2007, which are incorporated herein by reference in their entireties for the above purposes. The noise reduction module 320 provides a transformed, noise-suppressed signal to speech restoration module 330. In the noise-suppressed signal one or more speech components can be eliminated or excessively attenuated since the noise reduction transforms the frequency of the audio signal.

In some embodiments, the speech restoration module 330 receives the noise-suppressed signal from the noise reduction module 320. The speech restoration module 330 is configured to restore damaged speech components in noise-suppressed signal. In some embodiments, the speech restoration module 330 includes a deep neural network (DNN) 315 trained for restoration of speech components in damaged frequency regions. In certain embodiments, the DNN 315 is configured as an autoencoder.

In various embodiments, the DNN 315 is trained using machine learning. The DNN 315 is a feed-forward, artificial neural network having more than one layer of hidden units between its inputs and outputs. The DNN 315 may be trained by receiving input features of one or more frames of spectral envelopes of clean audio signals or undamaged audio signals. In the training process, the DNN 315 may extract learned higher-order spectro-temporal features of the clean or undamaged spectral envelopes. In various embodiments, the DNN 315, as trained using the spectral envelopes of clean or undamaged envelopes, is used in the speech restoration module 330 to refine predictions of the clean speech components that are particularly suitable for restoring speech components in the distorted frequency regions. By way of example and not limitation, exemplary methods concerning deep neural networks are also described in commonly assigned U.S. patent application Ser. No. 14/614,348, entitled "Noise-Robust Multi-Lingual Keyword Spotting with a Deep Neural Network Based Architecture," filed Feb. 4, 2015, and U.S. patent application Ser. No. 14/745,176, entitled "Key Click Suppression," filed Jun. 9, 2015, which are incorporated herein by reference in their entirety.

During operation, speech restoration module 330 can assign a zero value to the frequency regions of noise-suppressed signal where a speech distortion is present (distorted regions). In the example in FIG. 3, the noise-suppressed signal is further provided to the input of DNN 315 to receive an output signal. The output signal includes initial predictions for the distorted regions, which might not be very accurate.

In some embodiments, to improve the initial predictions, an iterative feedback mechanism is further applied. The output signal 350 is optionally fed back to the input of DNN 315 to receive a next iteration of the output signal, keeping the initial noise-suppressed signal at undistorted regions of the output signal. To prevent the system from diverging, the output at the undistorted regions may be compared to the input after each iteration, and upper and lower bounds may be applied to the estimated energy at undistorted frequency regions based on energies in the input audio signal. In various embodiments, several iterations are applied to improve the accuracy of the predictions until a level of accuracy desired for a particular application is met, e.g., having no further iterations in response to discrepancies of the audio signal at undistorted regions meeting pre-defined criteria for the particular application.

In some embodiments, reconstruction module 340 is operable to receive a noise-suppressed signal with restored speech components from the speech restoration module 330 and to reconstruct the restored speech components into a single audio signal.

Figure 4:
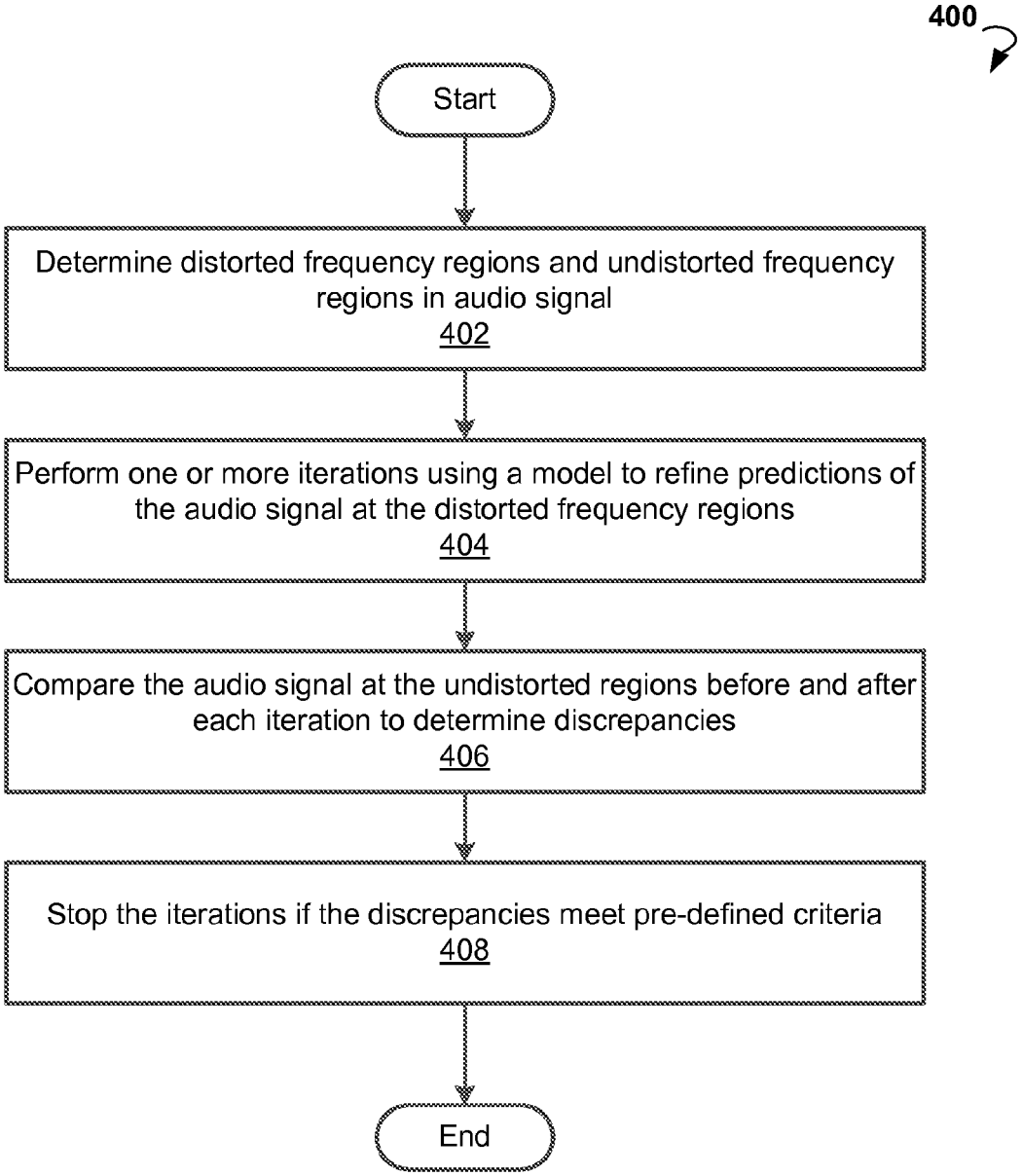
FIG. 4 is a flow chart illustrating a method for restoration of speech components of an audio signal, according to an example embodiment.

FIG. 4 is flow chart diagram showing a method 400 for restoring distorted speech components of an audio signal, according to an example embodiment. The method 400 can be performed using speech restoration module 330.

The method can commence, in block 402, with determining distorted frequency regions and undistorted frequency regions in the audio signal. The distorted speech regions are regions in which a speech distortion is present due to, for example, noise reduction.

In block 404, method 400 includes performing one or more iterations using a model to refine predictions of the audio signal at distorted frequency regions. The model can be configured to modify the audio signal. In some embodiments, the model includes a deep neural network trained with spectral envelopes of clean or undamaged signals. In certain embodiments, the predictions of the audio signal at distorted frequency regions are set to zero before to the first iteration. Prior to each of the iterations, the audio signal at undistorted frequency regions is restored to values of the audio signal before the first iteration.

In block 406, method 400 includes comparing the audio signal at the undistorted regions before and after each of the iterations to determine discrepancies.

In block 408, the iterations are stopped if the discrepancies meet pre-defined criteria.

Some example embodiments include speech dynamics. For speech dynamics, the audio processing system 210 can be provided with multiple consecutive audio signal frames and trained to output the same number of frames. The inclusion of speech dynamics in some embodiments functions to enforce temporal smoothness and allow restoration of longer distortion regions.

Various embodiments are used to provide improvements for a number of applications such as noise suppression, bandwidth extension, speech coding, and speech synthesis. Additionally, the methods and systems are amenable to sensor fusion such that, in some embodiments, the methods and systems for can be extended to include other non-acoustic sensor information. Exemplary methods concerning sensor fusion are also described in commonly assigned U.S. patent application Ser. No. 14/548,207, entitled "Method for Modeling User Possession of Mobile Device for User Authentication Framework," filed Nov. 19, 2014, and U.S. patent application Ser. No. 14/331,205, entitled "Selection of System Parameters Based on Non-Acoustic Sensor Information," filed Jul. 14, 2014, which are incorporated herein by reference in their entirety.

Various methods for restoration of noise reduced speech are also described in commonly assigned U.S. patent application Ser. No. 13/751,907 (U.S. Pat. No. 8,615,394), entitled "Restoration of Noise Reduced Speech," filed Jan. 28, 2013, which is incorporated herein by reference in its entirety.

Figure 5:
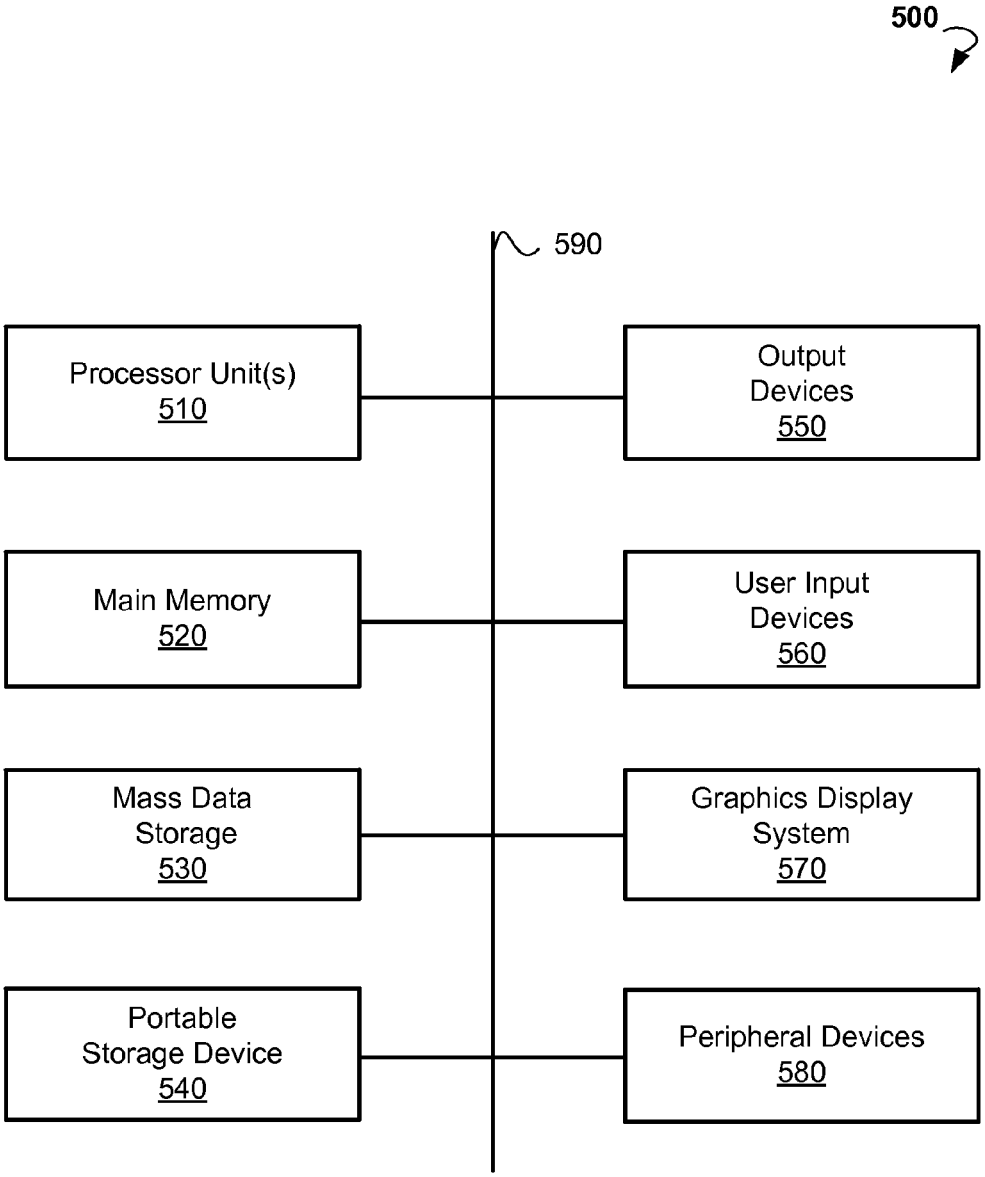
FIG. 5 is a computer system which can be used to implement methods of the present technology, according to an example embodiment.

FIG. 5 illustrates an exemplary computer system 500 that may be used to implement some embodiments of the present invention. The computer system 500 of FIG. 5 may be implemented in the contexts of the likes of computing systems, networks, servers, or combinations thereof. The computer system 500 of FIG. 5 includes one or more processor units 510 and main memory 520. Main memory 520 stores, in part, instructions and data for execution by processor units 510. Main memory 520 stores the executable code when in operation, in this example. The computer system 500 of FIG. 5 further includes a mass data storage 530, portable storage device 540, output devices 550, user input devices 560, a graphics display system 570, and peripheral devices 580.

The components shown in FIG. 5 are depicted as being connected via a single bus 590. The components may be connected through one or more data transport means. Processor unit 510 and main memory 520 is connected via a local microprocessor bus, and the mass data storage 530, peripheral device(s) 580, portable storage device 540, and graphics display system 570 are connected via one or more input/output (I/O) buses.

Mass data storage 530, which can be implemented with a magnetic disk drive, solid state drive, or an optical disk drive, is a non-volatile storage device for storing data and instructions for use by processor unit 510. Mass data storage 530 stores the system software for implementing embodiments of the present disclosure for purposes of loading that software into main memory 520.

Portable storage device 540 operates in conjunction with a portable non-volatile storage medium, such as a flash drive, floppy disk, compact disk, digital video disc, or Universal Serial Bus (USB) storage device, to input and output data and code to and from the computer system 500 of FIG. 5. The system software for implementing embodiments of the present disclosure is stored on such a portable medium and input to the computer system 500 via the portable storage device 540.

User input devices 560 can provide a portion of a user interface. User input devices 560 may include one or more microphones, an alphanumeric keypad, such as a keyboard, for inputting alphanumeric and other information, or a pointing device, such as a mouse, a trackball, stylus, or cursor direction keys. User input devices 560 can also include a touchscreen. Additionally, the computer system 500 as shown in FIG. 5 includes output devices 550. Suitable output devices 550 include speakers, printers, network interfaces, and monitors.

Graphics display system 570 include a liquid crystal display (LCD) or other suitable display device. Graphics display system 570 is configurable to receive textual and graphical information and processes the information for output to the display device.

Peripheral devices 580 may include any type of computer support device to add additional functionality to the computer system 500.

The components provided in the computer system 500 of FIG. 5 are those typically found in computer systems that may be suitable for use with embodiments of the present disclosure and are intended to represent a broad category of such computer components that are well known in the art. Thus, the computer system 500 of FIG. 5 can be a personal computer (PC), hand held computer system, telephone, mobile computer system, workstation, tablet, phablet, mobile phone, server, minicomputer, mainframe computer, wearable, or any other computer system. The computer may also include different bus configurations, networked platforms, multi-processor platforms, and the like. Various operating systems may be used including UNIX, LINUX, WINDOWS, MAC OS, PALM OS, QNX ANDROID, IOS, CHROME, TIZEN and other suitable operating systems.

The processing for various embodiments may be implemented in software that is cloud-based. In some embodiments, the computer system 500 is implemented as a cloud-based computing environment, such as a virtual machine operating within a computing cloud. In other embodiments, the computer system 500 may itself include a cloud-based computing environment, where the functionalities of the computer system 500 are executed in a distributed fashion. Thus, the computer system 500, when configured as a computing cloud, may include pluralities of computing devices in various forms, as will be described in greater detail below.

In general, a cloud-based computing environment is a resource that typically combines the computational power of a large grouping of processors (such as within web servers) and/or that combines the storage capacity of a large grouping of computer memories or storage devices. Systems that provide cloud-based resources may be utilized exclusively by their owners or such systems may be accessible to outside users who deploy applications within the computing infrastructure to obtain the benefit of large computational or storage resources.

The cloud may be formed, for example, by a network of web servers that comprise a plurality of computing devices, such as the computer system 500, with each server (or at least a plurality thereof) providing processor and/or storage resources. These servers may manage workloads provided by multiple users (e.g., cloud resource customers or other users). Typically, each user places workload demands upon the cloud that vary in real-time, sometimes dramatically. The nature and extent of these variations typically depends on the type of business associated with the user.

The present technology is described above with reference to example embodiments. Therefore, other variations upon the example embodiments are intended to be covered by the present disclosure.

What is claimed is:

1. A method for restoring speech components of an audio signal, the method comprising:

receiving an audio signal after it has been processed for noise suppression;

determining distorted frequency regions and undistorted frequency regions in the received audio signal that has been processed for noise suppression, the distorted frequency regions including regions of the audio signal in which speech distortion is present due to the noise suppression processing; and performing one or more iterations using a model to generate predictions of a restored version of the audio signal, the model being configured to modify the audio signal so as to restore the speech components in the distorted frequency regions.

2. The method of claim 1, wherein the audio signal is obtained by at least one of a noise reduction or a noise cancellation of an acoustic signal including speech.

3. The method of claim 2, wherein the speech components are attenuated or eliminated at the distorted frequency regions by the at least one of the noise reduction or the noise cancellation.

4. The method of claim 1, wherein the model includes a deep neural network trained using spectral envelopes of clean audio signals or undamaged audio signals.

5. The method of claim 1, wherein the iterations are performed so as to further refine the predictions used for restoring speech components in the distorted frequency regions.

6. The method of claim 1, wherein the audio signal at the distorted frequency regions is set to zero before a first of the one or more iterations.

7. The method of claim 1, wherein prior to performing each of the one or more iterations, the restored version of the audio signal at the undistorted frequency regions is reset to values of the audio signal before the first of the one or more iterations.

8. The method of claim 1, further comprising after performing each of the one or more iterations comparing the restored version of the audio signal with the audio signal at the undistorted frequency regions before and after the one or more iterations to determine discrepancies.

9. The method of claim 8, further comprising ending the one or more iterations if the discrepancies meet pre-determined criteria.

10. The method of claim 9, wherein the pre-determined criteria are defined by low and upper bounds of energies of the audio signal.

11. A system for restoring speech components of an audio signal, the system comprising:

at least one processor; and a memory communicatively coupled with the at least one processor, the memory storing instructions, which when executed by the at least one processor performs a method comprising:

receiving an audio signal after it has been processed for noise suppression;

determining distorted frequency regions and undistorted frequency regions in the received audio signal that has been processed for noise suppression, the distorted frequency regions including regions of the audio signal in which speech distortion is present due to the noise suppression processing; and performing one or more iterations using a model to generate predictions of a restored version of the audio signal, the model being configured to modify the audio signal so as to restore the speech components in the distorted frequency regions.

12. The system of claim 11, wherein the audio signal is obtained by at least one of a noise reduction or a noise cancellation of an acoustic signal including speech.

13. The system of claim 12, wherein the speech components are attenuated or eliminated at the distorted frequency regions by the at least one of the noise reduction or the noise cancellation.

14. The system of claim 11, wherein the model includes a deep neural network.

15. The system of claim 14, wherein the deep neural network is trained using spectral envelopes of clean audio signals or undamaged audio signals.

16. The system of claim 15, wherein the audio signal at the distorted frequency regions are set to zero before a first of the one or more iterations.

17. The system of claim 11, wherein before performing each of the one or more iterations, the restored version of the audio signal at the undistorted frequency regions is reset to values before the first of the one or more iterations.

18. The system of claim 11, further comprising, after performing each of the one or more iterations, comparing the restored version of the audio signal with the audio signal at the undistorted frequency regions before and after the one or more iterations to determine discrepancies.

19. The system of claim 18, further comprising ending the one or more iterations if the discrepancies meet pre-determined criteria, the pre-determined criteria being defined by low and upper bounds of energies of the audio signal.

20. A non-transitory computer-readable storage medium having embodied thereon instructions, which when executed by at least one processor, perform steps of a method, the method comprising:

receiving an audio signal after it has been processed for noise suppression;

determining distorted frequency regions and undistorted frequency regions in the received audio signal that has been processed for noise suppression, the distorted frequency regions including regions of the audio signal in which speech distortion is present due to the noise suppression processing; and performing one or more iterations using a model to refine predictions of the audio signal at the distorted frequency regions, the model being configured to modify the audio signal so as to restore speech components in the distorted frequency regions.

* * * * *